US006715620B2

(12) United States Patent
Taschek

(10) Patent No.: US 6,715,620 B2
(45) Date of Patent: Apr. 6, 2004

(54) DISPLAY FRAME FOR ALBUM COVERS

(76) Inventor: Martin Taschek, 92 Geneva St. #B P.O. Box 282, Williams Bay, WI (US) 53191

( * ) Notice: Subject to any disclaimer, the term of this patent is extended or adjusted under 35 U.S.C. 154(b) by 0 days.

(21) Appl. No.: 09/972,389

(22) Filed: Oct. 5, 2001

(65) Prior Publication Data

US 2003/0066225 A1 Apr. 10, 2003

(51) Int. Cl.[7] ..... A47G 29/00
(52) U.S. Cl. ..... 211/40; 40/611.06
(58) Field of Search ..... 40/649, 611.06; 211/40, 71.01, 85.17

(56) References Cited

U.S. PATENT DOCUMENTS 530,756 A * 12/1894 Evans et al. ..... 40/611
1,464,099 A * 8/1923 Herlihy ..... 40/611
3,337,059 A * 8/1967 Le Hoy ..... 211/107
3,702,132 A * 11/1972 Fites et al. ..... 206/387.15
4,196,812 A * 4/1980 McInnis ..... 211/40
4,290,530 A * 9/1981 Wooster ..... 211/40
4,299,043 A * 11/1981 Lathrop et al. ..... 40/624
4,461,107 A * 7/1984 Grate ..... 40/576
4,462,498 A * 7/1984 Walker, Jr. ..... 211/40
4,645,075 A * 2/1987 Van Der Lely ..... 206/387.15
4,919,287 A * 4/1990 Haskett et al. ..... 211/40
5,148,925 A * 9/1992 Althoff et al. ..... 211/40
D364,066 S * 11/1995 Haskett et al. ..... D6/629
5,544,436 A * 8/1996 Lefkowitz ..... 40/124.2
5,588,238 A * 12/1996 Visocky et al. ..... 40/618
5,626,926 A * 5/1997 Roberts ..... 428/14
5,667,083 A * 9/1997 Schnoor et al. ..... 211/41.12
5,682,694 A * 11/1997 Hillstrom ..... 40/574
5,765,695 A * 6/1998 Picciallo ..... 211/40
6,015,050 A * 1/2000 Gilbertson ..... 211/40

* cited by examiner

*Primary Examiner*—Andrea Chop

(57) ABSTRACT

A display device for displaying multiple album covers and allowing for display of one or more clamshell album covers in an open or closed configuration. Album covers can be inserted into display areas of the device or removed therefrom for handling and play substantially without movement or manipulation of the frame. In certain embodiments, each of the display areas can be independently accessed to insert or remove an album cover without disturbing album covers in the other display areas. Such independent access may be provided by way of vertical and/or horizontal slots formed in the frame.

12 Claims, 3 Drawing Sheets

DISPLAY FRAME FOR ALBUM COVERS

FIELD OF THE INVENTION

The present invention relates in general to devices for storing and displaying album covers and, in particular, to a display frame for displaying multiple album covers and allowing for display of one or more clamshell album covers in an open or closed configuration. The invention also allows for convenient insertion of album covers into a display area and removal of album covers or contained albums sleeves for handling and play, substantially without movement or manipulation of the frame.

BACKGROUND OF THE INVENTION

The advent of the digital recording revolution and compact disks has left many people with collections of albums, e.g., 33⅓ R.P.M. vinyl records, that are seldom if ever used. In many cases, the owners of these albums are reluctant to depart with these albums that may have been collected over a long period of time at what seemed substantial expense. Such reluctance is often not merely a matter of pecuniary concern, but reflects a great subjective value of the albums and album covers to the owner. In this regard, the owner may wish to retain albums for occasional playing because the recordings are not readily available in digital format, the owner does not wish to repurchase the recording in digital format or the owner simply prefers, in nostalgic moments, to use an old record player or hear the recording on vinyl in spite of (or perhaps because of) scratches, crackles and other historical artifact.

For many, album covers also have artistic value. Many recording artists designed their covers with great care understanding that their fans would spend substantial time enjoying the album covers while listening to the recordings. Such album covers artistically complemented the recordings in a way that, as a practical manner, is different from the way that today's listeners typically enjoy listening to multiple digital recordings loaded into a magazine or platter. Thus, for a certain generation, a glimpse of the album covers of Pink Floyd's "Dark Side of the Moon" or the Beatle's "Sgt. Pepper's Lonely Hearts Club Band" may evoke a flood of memories, and hearing certain songs may immediately evoke images of album covers. Such album covers also often included lyrics and other information that the album owner may wish to occasionally peruse even today.

It has now been more than a decade and perhaps two decades since most collectors purchased their last albums. There are undoubtedly millions of albums stored in attics, basements and closets in crates or cardboard boxes. Most of these collections will probably be disposed of eventually, once their owners decide that the albums will no longer be used, keeping the records is foolish sentimentality and the storage space can better be used for other purposes.

A number of display or storage devices for albums has been proposed. In some cases, such displays have provided for encasement of an album cover, e.g., behind glass, or have otherwise been designed in apparent contemplation of long-term storage like a kind of museum piece. However, such displays do not readily permit removal of the album covers or albums for periodic playing and use in the manner for which they were originally designed. Moreover, such displays are generally designed to store/display only a single sleeve album cover or closed clamshell album cover. Other storage units accommodate multiple albums, for example in book-like arrangement, but do not provide for simultaneous display of multiple album covers, including open clamshell covers, or do not allow for convenient access to albums/covers without movement or manipulation of the storage device.

SUMMARY OF THE INVENTION

The present invention is directed to a device for storing and displaying multiple album covers in a manner that allows for convenient removal of the album covers, or album/sleeves contained in the covers, for handling or play. The inventive device allows for storage of single sleeve album covers and for storage of clamshell album covers in a open or closed configuration. In certain embodiments, access to the album covers and/or sleeves and albums can be obtained substantially without moving or manipulating the display device which may be hung on a wall or the like, where it may be inconvenient to remove or manipulate the device.

In accordance with one aspect of the present invention, a device is provided for allowing simultaneous display of multiple album covers with independent access to individual album cover display areas. The device includes a wall mountable frame for supporting multiple album covers in separate display areas such that each of the album covers can be viewed from a front side of the frame. Independent access is provided to each of the display areas such that any one of the display areas can be accessed for inserting or removing an album cover while the other cover(s) remains displayed in its display area for viewing from the front of the frame. Preferably, each album cover can be accessed without removing the frame from the wall to permit convenient periodic access for handling or play. In this regard, access may be obtained via passive or stationary elements, such as slots, or via active elements such as flaps, covers, bars or hinged panels that can be deployed to access particular display areas. Such independent access advantageously reduces the need to handle album covers other than the one that the user desires to access or to manipulate associated frame portions, thereby simplifying access and reducing the potential of damage or wear.

In accordance with another aspect of the present invention, an album cover display device is provided that has slots for inserting and removing album covers to or from ("relative to") display areas. The slots preferably extend to a side or top edge of the device frame such that individual display areas can be accessed substantially without moving (e.g. dismounting the frame from the wall) or manipulating (e.g., deploying flaps, covers, bars, hinged panels or the like) the album cover display device. Preferably, the slots include pairs of slot ends that define ports at one or more of the frame edges for access to the display areas. In this regard, multiple ports are preferably provided to allow independent access to multiple display areas.

BRIEF DESCRIPTION OF THE DRAWINGS

For a more complete understanding of the present invention, and further advantages thereof, reference is now made to the following detailed description, taken in conjunction with the drawings, in which.

DETAILED DESCRIPTION

The present invention is directed to album cover display devices that allow for display of multiple album covers and that further allow for convenient access to individual album covers as may be desired. In the following description, the invention is set forth in the context of various embodiments that allow for access to album covers via slots formed in a frame. Those skilled in the art will appreciate that alternative implementations are possible in accordance with the teachings of the present invention. Accordingly, the following description should be understood as exemplifying the invention and not by way of limitation.

Figure 1A:
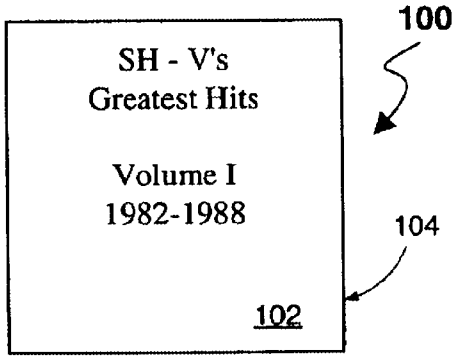
FIGS. 1A–1B show sleeve-type and clamshell album covers that can be displayed in the devices of the present invention.
Figure 1B:
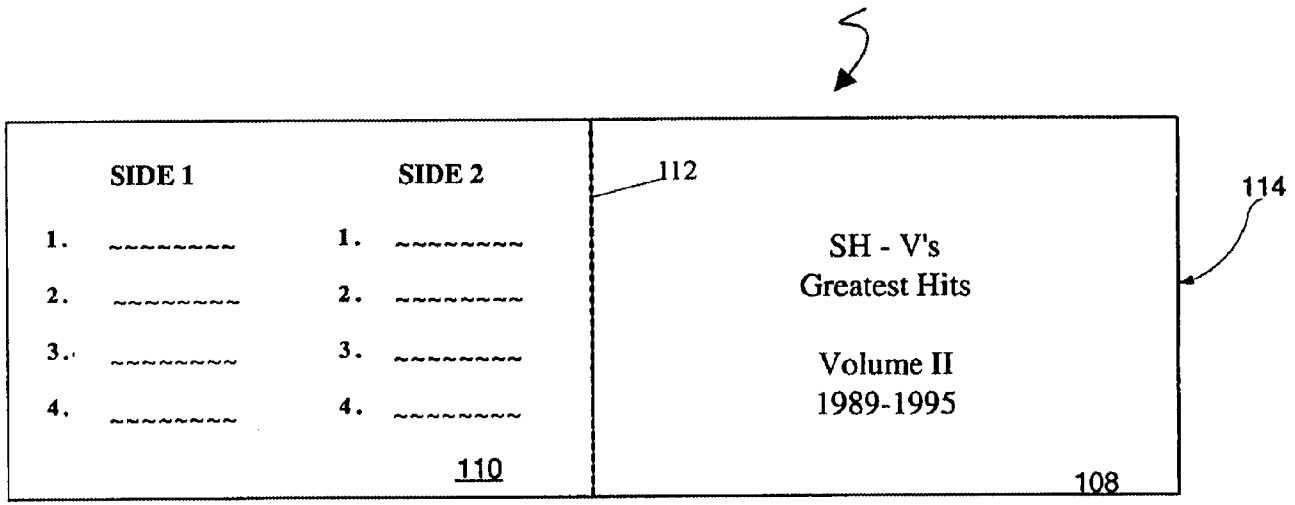

The display devices described below allow for simultaneous display of multiple album covers and for display of sleeve-type as well as clamshell album covers. FIGS. 1A–1B illustrate a sleeve-type album cover and a clamshell album cover respectively. As shown in FIG. 1A, the sleeve-type album cover 100 includes one slotted panel 102 for receiving and album therein. An additional paper or plastic sleeve may be received within the slotted edge 104 for further protecting the album. Typically, such album covers include a front face and a rear face where the front face includes artwork, the name of the artist and/or album, and other information. The rear face typically identifies the album contents, e.g., identifies the songs or other material that is included on each side of the album. Additional artwork and information such as credits for the artists, composers etc. may be included on the album cover.

A clamshell cover 106, as generally illustrated in FIG. 1B, typically includes two panels 108 and 110 that fold about a central crease 112. At least one of the panels 108 or 110 normally includes a slotted edge 114 to receive an album and protective sleeve therein. In the case of a double album, each of the panels 108 and 110 may be slotted. The front and rear sides of the album cover 106 may include information similar to that on sleeve-type album covers. Additional artwork and other information, such as lyrics, may be printed on the inner surfaces (not shown) of the album cover 106.

In the case of a sleeve-type album cover, it may be desired to display the cover so that either the front or backside can be viewed. In many cases, the front cover of the album is designed to be the primary display surface. It will further be appreciated that access for inserting an album/sleeve or removing an album/sleeve is provided via the slot, typically at the right edge of the album cover as viewed from the front side. In the case of a clamshell album cover, it may be desired to display more than one surface of the album cover. For example, when the album cover is unfolded, the front and back surfaces can be simultaneously viewed from a single vantage point. Alternatively, both of the inner surfaces can be viewed from a single vantage point, e.g., so as to peruse song lyrics or other information.

Figure 2B:
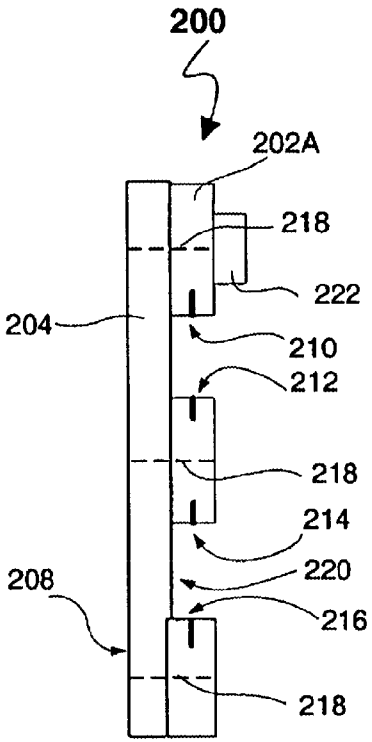
FIGS. 2A–2B are front perspective and side views, respectively, of an album cover display device in accordance with the present invention.
Figure 2A:
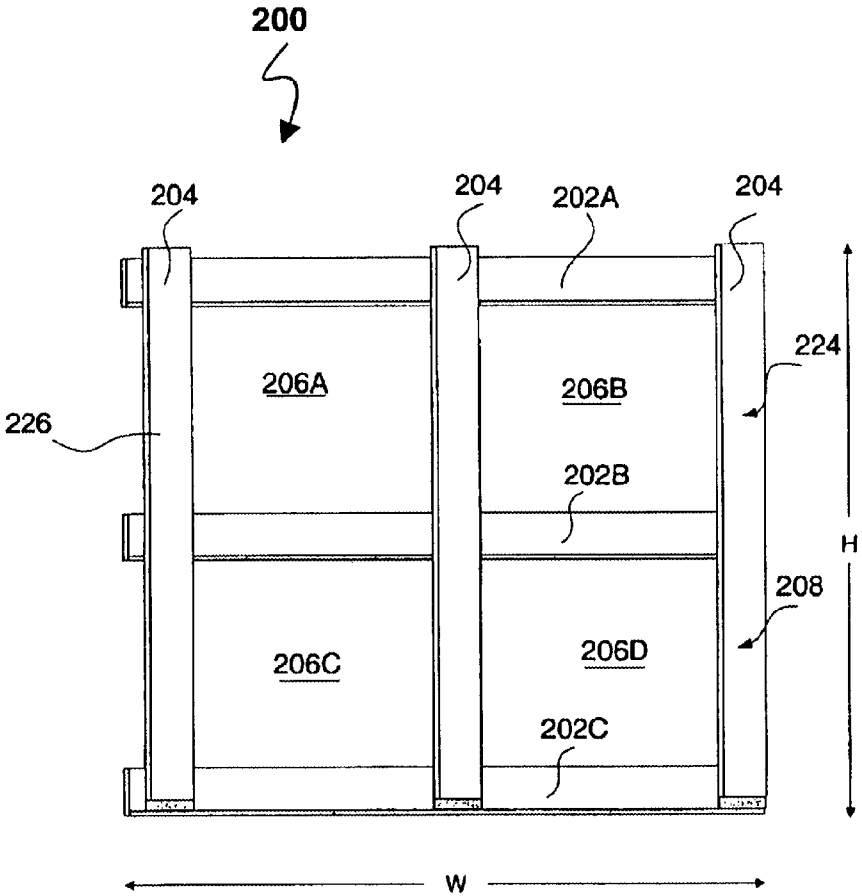

Referring to FIGS. 2A–2B, an album cover display device in accordance with present invention is generally identified by reference numeral 200. The display device 200 advantageously allows for simultaneous display of multiple album covers including sleeve-type album covers and/or clamshell album covers. Moreover, the display device 200 allows for independent access to multiple display areas.

As discussed above, independent access to multiple display areas may be provided in various ways including by use of passive and/or active elements. In the illustrated embodiment, such independent access is provided by way of a slotted frame. This implementation of the invention has certain advantages related to ease of construction, ease of the operation, and reduced potential for malfunction or wear.

In particular, the illustrated display device 200 includes a number of slotted crossbars 202A–C interconnected by a number of upright bars 204. Although alternative configurations are possible in accordance with the present invention as discussed below, the illustrated device 200 includes three crossbars 202A–C and three upright bars 204 defining four display areas 206A–D. The four display areas 206A–D allow for display of, for example, four sleeve-type album covers, four folded clamshell album covers, two unfolded clamshell covers, one unfolded clamshell cover and two sleeve-type or folded clamshell covers, or various other combinations.

The crossbars 202A–C include slots for slidably receiving the album covers. Specifically, the top crossbar 202A has a slot 210 formed in a bottom surface thereof. The center crossbar 202B has an upper slot 212 formed in a top surface thereof and a lower slot 214 formed in a bottom surface thereof and the bottom crossbar 202C. has a slot 216 formed in a top surface thereof. Preferably, the slots 210, 212, 214 and 216 extend to at least one of the side ends 224 or 226 of the device 200. In the illustrated embodiment, the slots 210,212,214 and 216 extend across the entire width of the device 200 to both side ends 224 and 226. In this manner, each of the display areas 206A–D can be independently accessed. That is, display area 206A can be accessed by sliding an album cover through slot pair 210,212 from the left side 224 of the device 200. Similarly, display area 206B can be accessed by sliding an album cover within slot pair 210,212 relative to the right side 226 of the device 200. Display area 206C can be accessed by sliding an album cover within slot pair 214, 216 relative to the left end 224 of the device 200. Finally, display area 206D can be accessed by sliding an album cover within slot pair 214, 216 relative to the right end 226 of the device 200. Thus, each of the display areas 206A–D can be independently accessed to insert or remove an album cover or to insert or remove an album/sleeve without removing the album cover. In the case of the clamshell album cover containing a double album, each album can be independently accessed.

The device 200, display areas 206A–D and slots 210, 212, 214 and 216 may be dimensioned to accommodate various types of albums. The illustrated device 200 is dimensioned to display conventional 33⅓ R.P.M. records and the slots 210, 212, 214 and 216 are dimensioned to receive either sleeve-type album covers or unfolded clamshell album covers. Moreover, the slots 210, 212, 214 and 216 are dimensioned to allow for sliding album covers therein with minimal friction. In this regard, the illustrated frame has a height, H, of about 29½ inches and a width, W, of about 30 inches. Each of the slots 210, 212, 214 and 216 has a width of about ⅛ of an inch. The upward facing slots 212 and 216 have a depth of about ⅛ inch. The downward facing slots 210 and 214 have a depth of about ⅜ of an inch. Each of the crossbars 202A–C and upright bars 104 may be conveniently constructed from wood 1×2s or 1×3s. The center crossbar 202B and center upright bar 104 are centered to form display areas 206A–D of substantially equal size. Such construction allows for display of album covers within the display areas 206A–D with minimal obstruction of the album cover surfaces while permitting access to the display areas 206A–D with minimal friction. In particular, because of the increased depth of the downward facing slots 210 and 214, an album cover can be lifted slightly as it is slid through the slots 210,212,214 and 216 to reduce friction and potential rubbing damage. If desired, the slots 210, 212, 214 and 216 may be treated to further reduce friction. For example, the slots 210, 212, 214 and 216 may be waxed or may be lined with felt or another soft material to facilitate sliding of album covers therein with reduced friction and correspondingly reduced potential for friction damage. The slots 210, 212,214 and 216 may be appropriately widened for this purpose.

The illustrated device 200 is preferably hung from a wall or other surface such that the slots 210,212,214 and 216 are oriented substantially horizontally, thereby reducing the likelihood that album covers will accidentally sliding out of the device 200. In this regard, a conventional picture hanger 222 may be attached to the backside of the top crossbar 202A at the center thereof. It will be appreciated that the crossbars 202A–C and upright bars 204 may be interconnected in a variety of ways. For example, in order to effect a strong and durable connection, the crossbars 202A–C and upright bars 204 may be attached using a tongue and groove connection secured by an adhesive or fasteners. Alternatively, for ease of construction, the crossbar s 202A–C and upright bars 204 may be stacked on top of one another and attached using fasteners such as nails, screws or the like. In such cases, either the crossbars 202A–C or upright bars 204 may be on the top/foreword face. In the illustrated embodiment, the upright bars 204 are disposed on top of the crossbars 202A–C. The crossbars 202A–C and upright bars 204 are interconnected by way of screws inserted from the rear side 220 of the device 200 through the crossbars 202A–C into the upright bars 204. In this regard, one screw may be used and each intersection of the crossbars 202A–C and upright bars 204. As shown in FIG. 2B, the screws are inserted along the axes 216 so as to avoid interference with the slots 210,212,214 and 216.

Figure 3A:
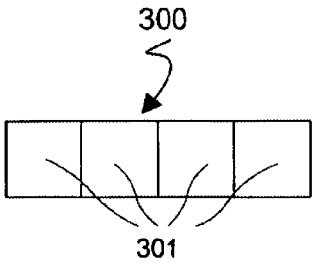
FIGS. 3A–3F show various alternative configurations of album cover display devices in accordance with present invention.

A number of alternative configurations of album cover display devices in accordance with present intention are shown in FIGS. 3A–3F. Referring first to FIG. 3A, a display device 300 is illustrated that includes four album cover display areas 301 arranged in a horizontal row. Accordingly, the device 300 may be used to display four sleeve-type or folded clamshell album covers, two unfolded album covers or combinations thereof. Slots for accessing the display areas 301 may be oriented vertically and/or horizontally. It will be appreciated that horizontal slots advantageously allow for display of unfolded clamshell covers. However, horizontal slots do not allow for independent access to the inner display areas 301. Thus, horizontal and/or vertical slots may be utilized depending on the intended use of the device 300. In the case of vertical slots, it will be appreciated that appropriate stops may be provided that the bases of such slots to retain album covers within the associated display areas 301.

Figure 3B:
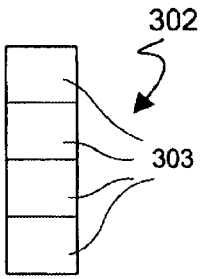

FIG. 3B illustrates a display device 302 including four album cover display areas 303 arranged in a vertical column. Again, access to the display areas 303 may be provided by vertical and/or horizontal slots. However, as it will generally be undesirable to display an unfolded clamshell album cover in a vertical configuration, horizontal slots may be sufficient for many applications of the illustrated device 302.

Figure 3C:
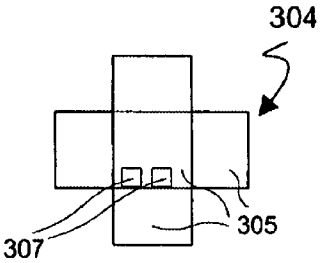

The device 304 of FIG. 3C includes five display areas 305 generally arranged in the shape of a cross. The display areas 305 may be accessed via vertical and/or horizontal slots. It will be appreciated that the central display area 305 cannot be independently access via slots as described above. In this regard, an alternative mechanism may be provided for allowing independent access to the central display area 305. For example, a hinge mechanism 307 may be built into the frame to allow the frame components that define the central display area 305 to pivot out of the plane of the plane of the remaining display areas for loading and unloading of album covers. Alternatively, the central display area 305 may be reserved for an unslotted panel of a clamshell cover or other covers/panels for which frequent access is not desired.

Figure 3D:
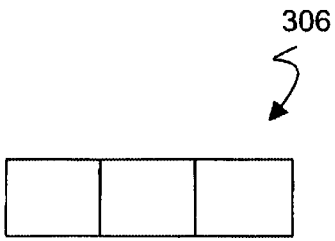
Figure 3E:
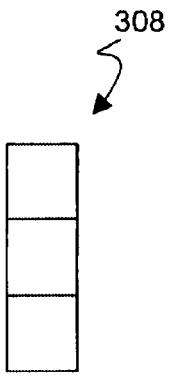

FIGS. 3D–3E illustrated devices 306 and 308 respectively similar to the embodiments of FIGS. 3A–3B but with only three display areas. Again, each of the display areas may be accessed via horizontal and/or vertical slots.

Figure 3F:
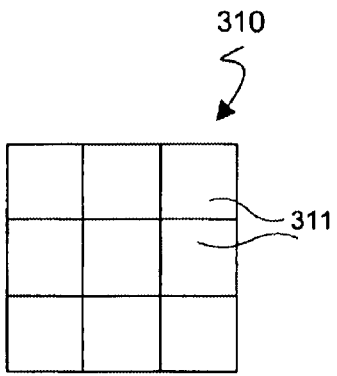

Finally, FIG. 3F illustrates a device 310 including nine display areas 311 arranged in a two-dimensional array. The display areas 311 may be accessed via vertical and/or horizontal slots. It will be appreciated that the central display area will require a mechanism other than slots if independent access is required.

While various embodiments of the present intention have been described in detail, it is apparent that further modifications and adaptations of the invention will occur to those skilled in the art. However, it is to be expressly understood that such modifications and adaptations are within the spirit and scope of the present invention.

What is claimed:

1. A device for storing and displaying album covers, each of said album covers having an open edge for receipt and removal of an album therethrough, comprising:

a first album cover;

a frame for supporting a plurality of album covers including said first album cover about peripheral portions thereof, said frame being adapted for supporting said plurality of album covers in a corresponding plurality of display areas defined by said frame such that a cover surface of each of said plurality of album covers is exposed for viewing when said album covers are disposed in said display areas;

a number of slots formed in said frame for slidably receiving said album covers therein, each of said slots including first and second exposed ends disposed at corresponding first and second edge portions of said frame and extending from said edge portions of said frame to one of said display areas, said first edge portion being disposed opposite said second edge portion relative to said frame;

said slots being configured such that said first album cover can be inserted through either the first exposed ends, at said first edge portion of said frame, or the second exposed ends at said second edge of said frame opposite said first edge, of a pair of said slots to display said first album cover in said one of said display areas, said slots being formed in said frame such that said pair of slots define a slotted passageway dimensioned for receiving said first album cover, wherein one of said first album cover and a contained album associated with said first album cover can be slidably received into and removed from said one of said display areas via one of a first port defined by the exposed first ends of said pair of said slots and a second port defined by the exposed second ends of said pair of said slots substantially free from movement of said frame; and a hanger interface associated with said frame for use in hanging said frame on a support surface such that said port is disposed on one of a side end and a top end of said frame.

2. A device as set forth in claim 1, wherein said frame is adapted for supporting said plurality of album covers in one substantially horizontal row, and said number of slots includes a first slot and a second slot wherein each of said plurality of covers is capable of being received within said first and second slots.

3. A device as set forth in claim 1, wherein said number of slots includes first and second slots for receiving a first album cover in a first one of said display areas and third and fourth slots for receiving a second album cover in a second display area, where said first display area is vertically offset from said second display area.

4. A device as set forth in claim 3, wherein said first and second display areas are aligned in a vertical column.

5. A device as set forth in claim 1, wherein said display areas include first, second and third display areas, said first display area being horizontally offset from said second display area and vertically offset from said third display area.

6. A device as set forth in claim 1, wherein said frame and slots are configured such that each of said display areas can be accessed for inserting an album cover therein or removing an album cover therefrom via said slots without traversing any other of said display areas.

7. A device as set forth in claim 1, wherein said port is disposed on a side end of said frame and said slots extend horizontally therefrom such that an album cover can be displayed in an upright orientation and an album contained in said album cover can be removed via said port without removing said album cover from said frame.

8. A device for storing and displaying album covers, each of said album covers having an open edge for receipt and removal of an album therethrough, comprising:

a first album cover;

a frame for supporting a plurality of album covers including said first album cover about peripheral portions thereof said frame being adapted for supporting said plurality of album covers in a corresponding plurality of display areas defined by said frame such that a cover surface of each of said plurality of album covers is exposed for viewing from a front of said frame when said albums are disposed in said display areas, said frame being constructed such that each of said display areas has a dimension substantially equal to a corresponding dimension of an album cover; and means for separately accessing each of said plurality of display areas via each of a first edge and a second edge, opposite said first edge, of each said display area wherein a first one of said display areas can be accessed to insert or remove said first album cover while a second album cover remains displayed within a second one of said display areas of said frame.

9. A device as set forth in claim 8, wherein said frame is adapted for supporting said plurality of album covers in one substantially horizontal row.

10. A device as set forth in claim 8, wherein said first and second display areas are aligned in a vertical column.

11. A device as set forth in claim 8, wherein said display areas include first, second and third display areas, said first display area being horizontally offset from said second display area and vertically offset from said third display area.

12. A device as set forth in claim 8, wherein said means for separately accessing comprises a number of slots formed in said frame.

* * * * *